United States Patent [19]

Hollmann et al.

[11] Patent Number: 4,523,538

[45] Date of Patent: Jun. 18, 1985

[54] TORPEDO LAUNCHER

[75] Inventors: Martin Hollmann, Cupertino, Calif.; Francis J. Waclawik, Bristol, R.I.

[73] Assignees: Westinghouse Electric Corp., Pittsburgh, Pa.; The United States of America as represented by the Secretary of the Navy, Washington, D.C.

[21] Appl. No.: 456,476

[22] Filed: Jan. 7, 1983

[51] Int. Cl.[3] ..... F41F 3/08

[52] U.S. Cl. ..... 114/238; 124/70

[58] Field of Search ..... 114/20 R, 238; 124/70

[56] References Cited

U.S. PATENT DOCUMENTS 4,159,705 7/1979 Jacoby ..... 124/70

FOREIGN PATENT DOCUMENTS 2462267 3/1977 Fed. Rep. of Germany ..... 114/238

*Primary Examiner*—Charles T. Jordan
*Assistant Examiner*—Ted L. Parr
*Attorney, Agent, or Firm*—F. J. Baehr, Jr.

[57] ABSTRACT

A torpedo launcher for a submarine, wherein the torpedo tube is encircled by a cylindrical enclosure and a sack is disposed in the cylindrical enclosure and the sack is in fluid communication with the breech end of the torpedo tube. The torpedo tube and sack are filled with seawater and pressurized air is rapidly supplied to the cylindrical enclosure to eject the torpedo from the torpedo tube.

7 Claims, 4 Drawing Figures

TORPEDO LAUNCHER

BACKGROUND OF THE INVENTION

This invention relates to torpedo launchers and more particularly to torpedo launchers for submarines.

A large variety of torpedo launchers for submarines exist, however these systems incorporate large water tanks and transfer machinery which is bulky and costly.

SUMMARY OF THE INVENTION

In general a torpedo launcher, when made in accordance with this invention, comprises a torpedo tube into which a torpedo is inserted, an enclosure adjacent the torpedo tube, a sack disposed in the enclosure and disposed in fluid communication with the torpedo tube, means for filling the torpedo tube and sack with water, and means for rapidly supplying pressurized fluid to the enclosure to compress the sack and eject the torpedo from the torpedo tube.

BRIEF DESCRIPTION OF THE DRAWINGS

The objects and advantages of this invention will become more apparent from reading the following detailed description in conjunction with the accompanying drawings, in which.

DESCRIPTION OF THE PREFERRED EMBODIMENT

Figure 1:
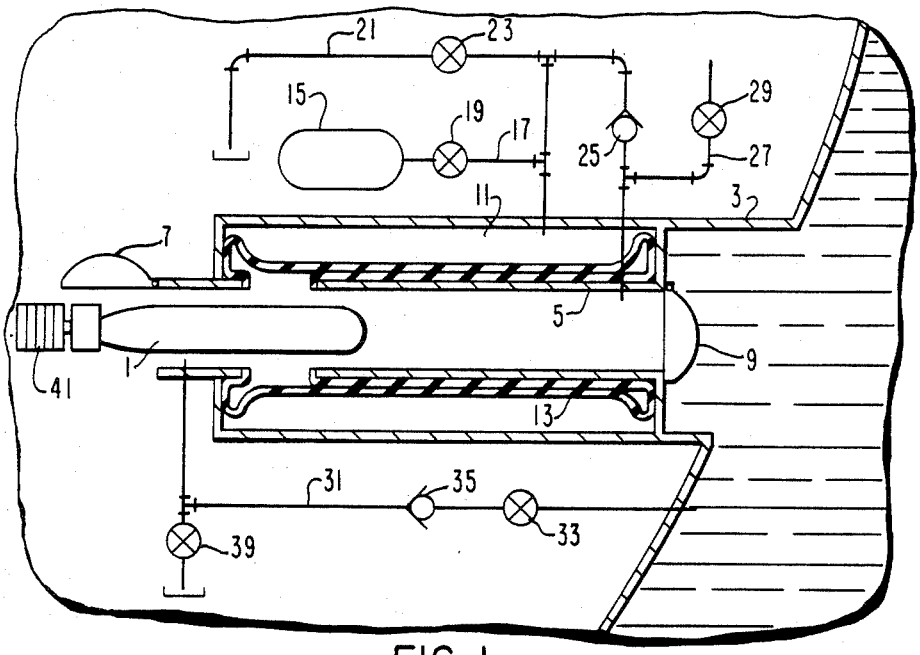
FIG. 1 is a schematic view of a torpedo launching system showing a torpedo being loaded into a torpedo tube.

Referring now to the drawings in detail and in particular to FIG. 1 there is shown a system for launching or ejecting a torpedo 1 from a submarine 3. The system comprises a torpedo tube 5 having a breech and a muzzle hatch 7 and 9, respectively, which form openable pressure tight closures on each end of the torpedo tube 5. Encircling the torpedo tube 5 is a cylindrical housing or enclosure 11 and disposed in the enclosure 11 is a bladder or sack 13, which is in fluid communication with the breech end of the torpedo tube 5. The sack 13 when expanded generally fills the enclosure 11. A supply of air or other pressurized fluid is indicated at 15 and is in fluid communication with the cylindrical enclosure 11 via a conduit 17. A firing valve 19 is disposed in the conduit 17 to control the flow of pressurized air to the cylindrical enclosure 11. A bleed conduit 21 is in fluid communication with the torpedo tube 5 and the cylindrical enclosure 11 and has a bleed valve 23 and a check valve 25 disposed therein, the check valve 25 being disposed in the portion of the conduit in communication with the torpedo tube 5. A vent conduit 27 and vent valve 29 are disposed in fluid communication in the bleed conduit 21 between the check valve 25 and the torpedo tube 5.

A flooding conduit 31 is in fluid communication with the torpedo tube 5 and with seawater outside of the submarine and has a flooding valve 33 and check valve 35 disposed therein. A blow down conduit 37 is in fluid communication with the torpedo tube 5 and has a blow down valve 39 disposed therein. Various conduits are shown coextensive as they enter the torpedo tube 5 and the cylindrical enclosure 11 in order to reduce the number of openings in these vessels. However, it is understood that each conduit could be separate and distinct.

Figure 2:
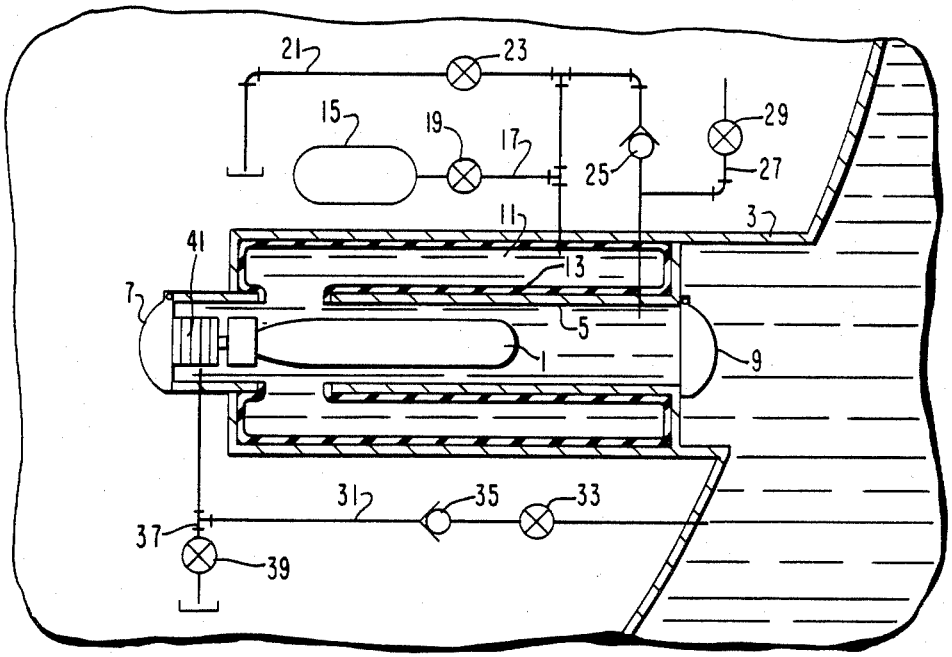
FIG. 2 shows the system filling with water.
Figure 3:
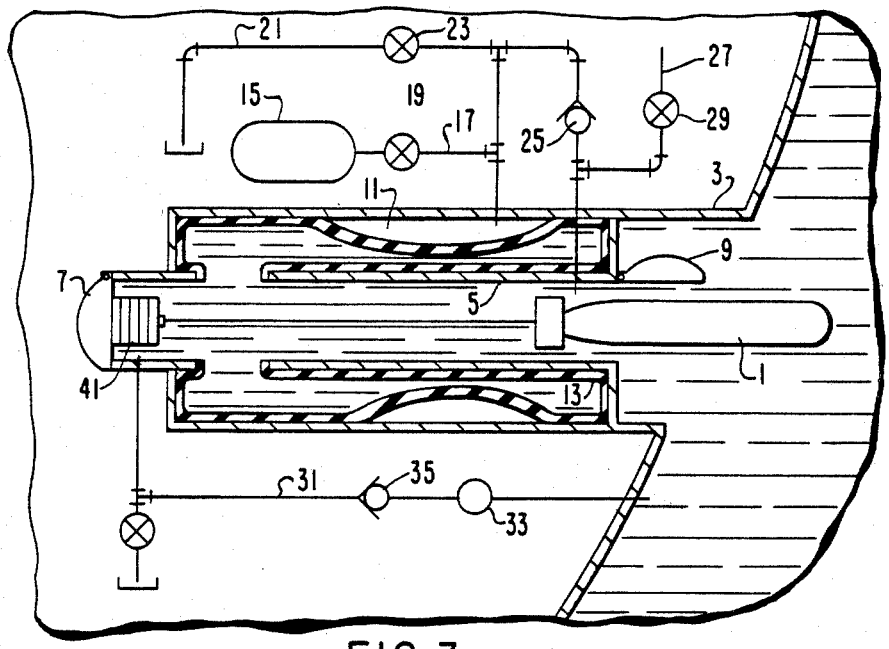
FIG. 3 shows the system as the torpedo is being ejected therefrom.
Figure 4:
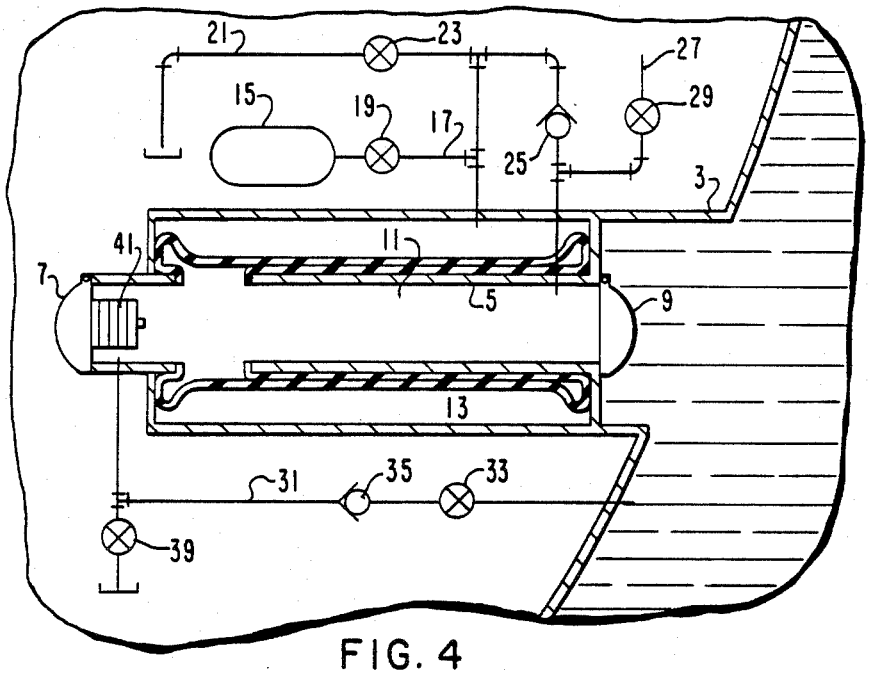
FIG. 4 shows the system as the water is being drained from the torpedo tube after the torpedo has been ejected.

The operation of the launch system is as follows:

Liquid is drained from the torpedo tube 5 and sack 13 and all of the valves 19, 23, 25, 29, 33, 35 and 39 are closed. The breech hatch 7 is opened and a torpedo 1 having a wire dispenser 41 is inserted into the torpedo tube 5. The breech hatch 7 is closed and the flooding valve 33 and bleed valve 23 are open allowing seawater to fill the torpedo tube 5 and sack 13. The sack 13 is heavy enough to remain collapsed to keep out the air until the torpedo tube is filled with water and then the water fills the sack 13 as shown in FIG. 2. The pressure in the torpedo tube 5 and sack 13 and outside the submarine are equal so that the muzzle hatch 9 can be opened. Once the muzzle hatch 9 is open the firing valve 19 is opened supplying compressed air to the cylindrical enclosure 11 rapidly compressing the sack 13 and injecting a large amount of water into the breech end of the torpedo tube 5 to eject or launch the torpedo 1 as shown in FIG. 3. The nozzle hatch is then closed as shown in FIG. 4 and the drain and vent valves 39 and 29, respectively, are opened draining seawater from the torpedo tube 5 to prepare for reloading.

We claim:

1. A torpedo launcher comprising:
   - a torpedo tube into which a torpedo is inserted;
   - an enclosure adjacent said torpedo tube;
   - a sack disposed in said enclosure and disposed in fluid communication with said torpedo tube;
   - means for filling said torpedo tube and sack with water; and
   - means for rapidly supplying pressurized fluid to said enclosure to compress said sack and eject said torpedo from said torpedo tube.

2. A torpedo launcher as set forth in claim 1, wherein the enclosure encircles the torpedo tube.

3. A torpedo launcher as set forth in claim 1, wherein the torpedo tube has a breech and a muzzle end and the sack is in fluid communication with the breech end thereof.

4. A torpedo launcher as set forth in claim 3 wherein the breech and muzzle end each have a hatch.

5. A torpedo launcher as set forth in claim 1 wherein the pressurized fluid is air.

6. A torpedo launcher as set forth in claim 5 and further comprising means for draining water from said torpedo tube.

7. A torpedo launcher as set forth in claim 6 and further comprising means for venting air from said torpedo tube and said enclosure.

* * * * *